US009464508B2

(12) United States Patent
Lerche et al.

(10) Patent No.: US 9,464,508 B2
(45) Date of Patent: Oct. 11, 2016

(54) INTERACTIVE AND/OR SECURE ACTIVATION OF A TOOL

(75) Inventors: Nolan C. Lerche, Stafford, TX (US); James E. Brooks, Manvel, TX (US); Simon L. Farrant, Paris (FR); Edward H. Rogers, Brookside Village, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 609 days.

(21) Appl. No.: 12/401,296

(22) Filed: Mar. 10, 2009

(65) Prior Publication Data

US 2009/0168606 A1 Jul. 2, 2009

Related U.S. Application Data

(60) Division of application No. 11/617,317, filed on Dec. 28, 2006, now Pat. No. 7,520,323, which is a division of application No. 10/076,993, filed on Feb. 15, 2002, now Pat. No. 7,383,882, which is a continuation-in-part of application No. 09/997,021, filed on Nov. 28, 2001, now Pat. No. 6,938,689, which is a continuation-in-part of application No. 09/179,507, filed on Oct. 27, 1998, now Pat. No. 6,283,227.

(51) Int. Cl.

| | |
|---|---|
| ***E21B 43/11*** | (2006.01) |
| ***E21B 41/00*** | (2006.01) |
| ***E21B 43/1185*** | (2006.01) |
| ***E21B 43/119*** | (2006.01) |
| ***E21B 47/12*** | (2012.01) |
| ***F42D 1/05*** | (2006.01) |

(52) U.S. Cl.

CPC ..... *E21B 41/00* (2013.01); *E21B 41/0021* (2013.01); *E21B 43/119* (2013.01); *E21B 43/1185* (2013.01); *E21B 43/11857* (2013.01); *E21B 47/12* (2013.01); *F42D 1/05* (2013.01)

(58) Field of Classification Search

CPC ..... E21B 43/11
USPC ..... 166/55.1
See application file for complete search history.

(56) References Cited

U.S. PATENT DOCUMENTS 2,655,619 A 10/1953 Neal
3,181,463 A 5/1965 Morgan et al.
(Continued)

FOREIGN PATENT DOCUMENTS

DE 19934789 5/2001
EP 29671 B1 9/1983
(Continued)

OTHER PUBLICATIONS

"Performance Criteria for Small Slapper Detonators", Controller, Her Majesty's Stationery Office, London, 1984.
(Continued)

*Primary Examiner* — Sunil Singh
(74) *Attorney, Agent, or Firm* — Tuesday Kaasch; Jeffery R. Peterson

(57) ABSTRACT

A tool activation system and method includes receiving an authorization code of a user to verify access rights of a user to activate the tool. In one example, the authorization code is receive from a smart card. The environment around the tool, which can be in a wellbore, for example, is checked. In response to the authorization code and the checking of the environment, activation of the tool is enabled.

11 Claims, 7 Drawing Sheets

(56) References Cited

U.S. PATENT DOCUMENTS

| | | | | |
|---|---|---|---|---|
| 3,327,791 | A | 6/1967 | Harrigan, Jr. | |
| 3,366,055 | A | 1/1968 | Lewis, Jr. | |
| 3,517,758 | A | 6/1970 | Schuster | |
| 3,566,117 | A * | 2/1971 | Tixier | 250/264 |
| 3,640,224 | A | 2/1972 | Petrick et al. | |
| 3,640,225 | A | 2/1972 | Carlson et al. | |
| 3,704,749 | A | 12/1972 | Estes et al. | |
| 3,758,731 | A | 9/1973 | Vann et al. | |
| 3,978,791 | A | 9/1976 | Lemley et al. | |
| 4,041,865 | A | 8/1977 | Evans et al. | |
| 4,052,703 | A | 10/1977 | Collins, Sr. et al. | |
| 4,078,174 | A * | 3/1978 | Goldman | 376/165 |
| 4,137,850 | A | 2/1979 | Donner et al. | |
| 4,208,966 | A | 6/1980 | Hart et al. | |
| 4,306,628 | A | 12/1981 | Adams et al. | |
| 4,307,663 | A | 12/1981 | Stonestrom et al. | |
| 4,393,779 | A | 7/1983 | Brede et al. | |
| 4,398,272 | A * | 8/1983 | Sibert | 367/33 |
| 4,421,030 | A | 12/1983 | DeKoker et al. | |
| 4,422,381 | A | 12/1983 | Barrett et al. | |
| 4,441,427 | A | 4/1984 | Barrett | |
| 4,471,697 | A | 9/1984 | McCormick et al. | |
| 4,496,010 | A | 1/1985 | Chapman | |
| 4,517,497 | A | 5/1985 | Malone et al. | |
| 4,527,636 | A | 7/1985 | Bordon | |
| 4,592,280 | A | 6/1986 | Shores et al. | |
| 4,602,565 | A | 7/1986 | MacDonald et al. | |
| 4,632,034 | A | 12/1986 | Colle et al. | |
| 4,638,712 | A | 1/1987 | Chawla et al. | |
| 4,646,640 | A | 3/1987 | Florin et al. | |
| 4,662,281 | A | 5/1987 | Wilhelm et al. | |
| 4,674,047 | A | 6/1987 | Tyler et al. | |
| 4,700,629 | A | 10/1987 | Benson et al. | |
| 4,708,060 | A | 11/1987 | Bickes et al. | |
| 4,729,315 | A | 3/1988 | Proffit et al. | |
| 4,735,145 | A | 4/1988 | Johnson et al. | |
| 4,762,067 | A | 8/1988 | Barker et al. | |
| 4,763,259 | A * | 8/1988 | Delatorre et al. | 702/11 |
| 4,777,878 | A | 10/1988 | Johnson et al. | |
| 4,788,913 | A | 12/1988 | Stroud et al. | |
| 4,831,933 | A | 5/1989 | Nerheim et al. | |
| 4,843,964 | A | 7/1989 | Bickes et al. | |
| 4,884,506 | A | 12/1989 | Guerreri et al. | |
| 4,886,126 | A | 12/1989 | Yates | |
| 4,944,225 | A | 7/1990 | Barker | |
| 5,014,622 | A | 5/1991 | Jullian et al. | |
| 5,044,437 | A | 9/1991 | Wittrisch | |
| 5,088,413 | A | 2/1992 | Huber et al. | |
| 5,094,166 | A | 3/1992 | Hendley et al. | |
| 5,094,167 | A | 3/1992 | Hendley, Jr. | |
| 5,105,742 | A | 4/1992 | Sumner | |
| 5,132,904 | A * | 7/1992 | Lamp | 700/282 |
| 5,144,680 | A * | 9/1992 | Kobayashi et al. | 382/124 |
| 5,172,717 | A | 12/1992 | Boyle et al. | |
| 5,295,438 | A | 3/1994 | Hill et al. | |
| 5,343,963 | A | 9/1994 | Bouldin et al. | |
| 5,347,929 | A | 9/1994 | Lerche et al. | |
| 5,413,045 | A | 5/1995 | Miszewski et al. | |
| 5,505,134 | A | 4/1996 | Brooks et al. | |
| 5,520,114 | A | 5/1996 | Guimard et al. | |
| 5,539,636 | A | 7/1996 | Marsh et al. | |
| 5,579,283 | A | 11/1996 | Owens et al. | |
| 5,706,892 | A | 1/1998 | Aeschbacher, Jr. et al. | |
| 5,742,756 | A * | 4/1998 | Dillaway et al. | 726/20 |
| 5,756,926 | A | 5/1998 | Bonbrake et al. | |
| 5,895,906 | A | 4/1999 | Danielson et al. | |
| 5,923,757 | A | 7/1999 | Hocker et al. | |
| 6,008,735 | A | 12/1999 | Chiloyan et al. | |
| 6,012,015 | A | 1/2000 | Tubel | |
| 6,032,739 | A | 3/2000 | Newman | |
| 6,041,860 | A | 3/2000 | Nazzal et al. | |
| 6,088,730 | A | 7/2000 | Kato et al. | |
| 6,092,724 | A | 7/2000 | Bouthillier et al. | |
| 6,094,609 | A | 7/2000 | Arjomand | |
| 6,148,263 | A | 11/2000 | Brooks et al. | |
| 6,173,651 | B1 | 1/2001 | Pathe et al. | |
| 6,192,988 | B1 | 2/2001 | Tubel | |
| 6,195,589 | B1 | 2/2001 | Ketcham et al. | |
| 6,283,227 | B1 | 9/2001 | Lerche et al. | |
| 6,310,829 | B1 * | 10/2001 | Green et al. | 367/82 |
| 6,464,011 | B2 | 10/2002 | Tubel | |
| 6,500,262 | B1 | 12/2002 | Bednarz et al. | |
| 6,557,636 | B2 | 5/2003 | Cernocky et al. | |
| 6,604,548 | B2 | 8/2003 | Geisinger | |
| 6,938,689 | B2 | 9/2005 | Farrant et al. | |
| 7,383,882 | B2 | 6/2008 | Lerche et al. | |
| 7,520,323 | B2 | 4/2009 | Lerche et al. | |
| 2001/0052426 | A1 | 12/2001 | Mercer et al. | |
| 2002/0062991 | A1 | 5/2002 | Farrant et al. | |
| 2003/0000411 | A1 | 1/2003 | Cernocky et al. | |
| 2003/0001753 | A1 | 1/2003 | Cernocky et al. | |
| 2003/0075069 | A1 | 4/2003 | Boucher et al. | |

FOREIGN PATENT DOCUMENTS

| | | | |
|---|---|---|---|
| EP | 386860 | B1 | 12/1993 |
| EP | 601880 | A2 | 6/1994 |
| EP | 0604694 | | 7/1994 |
| GB | 677824 | A | 8/1952 |
| GB | 693164 | A | 6/1953 |
| GB | 1555390 | A | 11/1979 |
| GB | 2118282 | A | 10/1983 |
| GB | 2100395 | B | 8/1984 |
| GB | 2190730 | A | 11/1987 |
| GB | 2222844 | A | 3/1990 |
| GB | 2226872 | A | 7/1990 |
| GB | 2265209 | A | 9/1993 |
| GB | 2290855 | A | 1/1996 |
| GB | 2343537 | A | 5/2000 |
| GB | 2352261 | A | 1/2001 |
| GB | 2384140 | A | 7/2003 |
| WO | 95/19489 | A | 7/1995 |
| WO | 96/23195 | A | 8/1996 |
| WO | 9624752 | A2 | 8/1996 |
| WO | 9838470 | A1 | 9/1998 |
| WO | 9927224 | A1 | 6/1999 |
| WO | 0159401 | A1 | 8/2001 |
| WO | 0171272 | A2 | 9/2001 |
| WO | 02/061461 | A | 8/2002 |

OTHER PUBLICATIONS

Bickes, Jr., R. W. , "SCB Explosive Studies", Initiating and Pyrotechnic Components Division 25 I 5, undated.

Brooks, J. E. , "A Simple Method for Estimating Well Productivity", SPE European Formation Damage Conference, The Hague. The Netherlands, Jun. 2-3 1997, Jun. 2-3.

Official Action for CA 2,418,758 mailed on Dec. 11, 2006, 3 pages.

Official Action for CA 2,418,758 mailed on Nov. 9, 2005, 3 pages.

Cheng, J. C., "Shock Initiation of PETN", Monsanto Research Corporation, Miamisburg, Ohio, 1-35.

Official Action for DE 10306747.7 mailed on Sep. 13, 2011, 12 pages.

Summons for Hearing for DE10306747.7 mailed on Jun. 11, 2014, 6 pages.

Dinegar, R. H., "High-Temperature-Stable Detonators", Proc. 12'" Symposium on Explosives and Pyrotechnics, Los Alamos National, Laboratory, San Diego. California, 1984, 4-1 through 4-4.

Combination Search and Examination Report for GB 0302937.8 mailed on May 29, 2003, 4 pages.

Examination Report for GB 0302937.8 mailed on Feb. 27, 2004, 1 page.

Notification of Grant for GB 0302937.8 mailed on Aug. 10, 2004, 2 pages.

Combination Search and Examination Report for GB 0404123.2 mailed on Apr. 1, 2004, 5 pages.

Examination Report GB 0404123.2 mailed on May 13, 2005, 1 page.

Notification of Grant for GB 0404123.2 mailed on Oct. 25, 2005, 1 page.

(56) References Cited

OTHER PUBLICATIONS

Combined Search and Examination Report for GB 0404126.5 mailed on Apr. 1, 2004, 4 pages.
Examination Report for GB 0404126.5 mailed on Nov. 8, 2004, 2 pages.
Search and Examination Report for GB0404123.2 mailed on Nov. 8, 2004, 3 pages.
Grief, D. et al., "Pyrotechnic Ignition in Minislapper Devices", Aldermaston. Reading RG7 4PR, Berkshire, England. Controller. HMSO, London, 1981, 43-1 through 43-10.
Guenther, A. H. et al., "Acceleration of Thin Plates by Exploding Foil Techniques", Pulse Power Laboratory. Physics Division, Research Directorate Air Force Special Weapons Center, Kirtland Air Foree Base, New Mexico, 279-298.
Jacobson, A. K., "A Low-Energy Aying Plate Detonator", Sandia National Laboratories Repon, Sand 81-0487C, Albuquerque, New Mexico, 1981, 49-1 through 49-20.
James, H. R., "Critical Energy Criterion ror the Shock Initiation of Explosives by Projectile Impact", Propellants, Explosives, Pyrotechnics,13, 1988, 35-41.
Keller, D. V. et al., "Exploding Foils- The Production of Plane Shoek Waves and the Acceleration of Thin Plates", The Boeing Company, Seattle, Washington, 263-277.
Lechen, H., "Sequential Perforations in Boreholes", ANTARES Datensysteme GmbH, Jan. 1998.
Lieberman, M. L. , "CP DDT Detonators: U. Output Characterization", Sandia National Laboratories Report SAND 83/1893, Albuquerque, New Mexico, 3-112.
Lindemuth, I. R. et al., "Exploding Metallic Foils for Slapper. Fuse, and HO( Plasma Applications: Computational Predictions. Experimental 69 Observations", Thermonuclear Applications Group, Applied Theoretical Physics Division, Detonation Systems Group, Dynamic Testing Division, Los Alamos National Laboratory. Los Alamos, New Mexico, 299—305.
Meyers, W. H., "Application of Slapper Detonator Technology to the Design of Special Detonation Systems", Proc. 12th Symposium on Explosives and Pyrotechnics, San Diego, California, Detonation Systems Development, Los Alamos National Laboratory, Mar. 13-15, 1984, 4-5 and 4-19.
Murr, L. E. et al., "Effect of Shock-Stress Duration on the Residual Structure and Hardness of Nickel, Chrome!, and Inconel", Materials Science and Engineering, 19, 1975, 115-122.
Official Action for NO 20030711 mailed on Aug. 31, 2007, 3 pages.
Official Action for NO 20030711 mailed on Sep. 27, 2006, 5 pages.
Richardson, D. D. et al., "A Fast, low Resistance Switch for Small Slapper Detonators", Depanment of Defense Materials Research Laboratories Report MRL-R-1030, Victoria. Australia.
Richardson, D. D. , "The Effect Switch Resistance on the Ringdown of a Slapper Detonator Fireset", Department of Defense Materials Research Laboratories Report MRL-R-1004, Victoria. Australia.
Scorzelli, R. B. et al., "Mossbauer Study of Shock-Induced Effects in the Ordered Alloy Fe50i50 In Meteorites", J. Phys. F: Met. Phys. 17, 1987, 71-83.
Stroud, J. R. , "A New Kind of Detonator- the Slapper", Lawrence Uvermore Laboratory, University of California. Uvermore, California, 22-1 through 22-6.
Wilcox, P. D., "Unique Features of SCBs", Initiating and Pyr()(echnic Components Division 25 I 5.
Yadav, H S. et al., "Flyer Plate Motion and Its Defonnation During Right", Int J. Impact Engng, 7(1), 1988, 71-83.
Ziegler, K., "New Developments in the Filed of Firing Techniques", Propellants, Explosives, Pyrotechnics, 12, 1987, 115-120.
Office Action issued in related CA application 2411819 on Jun. 1, 2009, 3 pages.
Office Action issued in related CA application 2411819 on Mar. 16, 2010, 3 pages.
Office Action issued in related CA application 2411819 on Oct. 27, 2011, 2 pages.
Office Action issued in related CA application 2617375 on Jul. 7, 2010, 2 pages.
Office Action issued in related CA application 2617375 on Sep. 1, 2009, 2 pages.
Decision to Grant issued in related DE application 10255757.8 on Apr. 29, 2014, 6 pages.
Office Action issued in related DE application 10255757.8 on Mar. 2, 2012, 4 pages.
Examination Report issued in related GB application 0226409.1 on Dec. 12, 2003, 2 pages.
Notification to Grant issued in related GB application 0226409.1 on May 18, 2004, 2 pages.
Notification of Allowability issued in related Indonesian application P-00200200811 on Aug. 19, 2011, 8 pages.
International Preliminary Examination Report issued in related PCT application PCT/US99/25014 on May 11, 2001, 6 pages.
International Search Report issued in related PCT application PCT/US99/25014 on Jan. 26, 2000, 3 pages.

* cited by examiner

INTERACTIVE AND/OR SECURE ACTIVATION OF A TOOL

CROSS REFERENCE TO RELATED APPLICATIONS

This is a divisional of U.S. Ser. No. 11/617,317 now U.S. Pat. No. 7,520,323, filed Dec. 28, 2006 herein incorporated by reference, which is a divisional of U.S. Ser. No. 10/076,993, filed Feb. 15, 2002, now U.S. Pat. No. 7,383,882, which is a continuation-in-part of U.S. Ser. No. 09/997,021, filed Nov. 28, 2001, now U.S. Pat. No. 6,938,689, which is a continuation-in-part of U.S. Ser. No. 09/179,507, filed Oct. 27, 1998, now U.S. Pat. No. 6,283,227.

TECHNICAL FIELD

The invention relates generally to interactive and/or secure activation of tools, such as tools used in well, mining, and seismic applications.

BACKGROUND

Many different types of operations can be performed in a wellbore. Examples of such operations include firing guns to create perforations, setting packers, opening and closing valves, collecting measurements made by sensors, and so forth. In a typical well operation, a tool is run into a wellbore to a desired depth, with the tool being activated thereafter by some mechanism, e.g., hydraulic pressure activation, electrical activation, mechanical activation, and so forth.

In some cases, activation of downhole tools creates safety concerns. This is especially true for tools that include explosive devices, such as perforating tools. To avoid accidental detonation of explosive devices in such tools, the tools are typically transferred to the well site in an unarmed condition, with the arming performed at the well site. Also, there are safety precautions taken at the well site to ensure that the explosive devices are not detonated prematurely. Another safety concern that exists at a well site is the use of wireless, especially radio frequency (RF), devices, which may inadvertently activate certain types of explosive devices. As a result, such wireless devices are usually not allowed at a well site, thereby limiting communications options that are available to well operators. Yet another concern associated with using explosive devices at a well site is the presence of stray voltages that may inadvertently detonate the explosive devices.

A further safety concern with explosive tools is that they may fall into the wrong hands. Such explosive tools pose great danger to persons who do not know how to handle explosive tools, or who want to use the explosive tools to harm others.

In addition to well applications, other applications that involve the use of explosive tools include mining applications and seismic applications. Similar types of safety concerns exist with such other types of explosive tools. Thus, a need continues exist to enhance the safety associated with the use of explosive tools as well as with other types of tools. Also, a need continues to exist to enhance the flexibility of controlling the operation of such explosive tools.

SUMMARY OF THE INVENTION

In general, an improved method and apparatus is provided to enhance the safety and flexibility associated with use of a tool. For example, a method of activating a tool includes checking an authorization code of a user to verify that the user has access to activate the tool. In addition, data pertaining to an environment around the tool is received. Activation of the tool is enabled in response to the authorization code and the data indicating that the environment around the tool meets predetermined one or more criteria for activation of the tool.

Other or alternative features will become apparent from the following description, the drawings, and the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
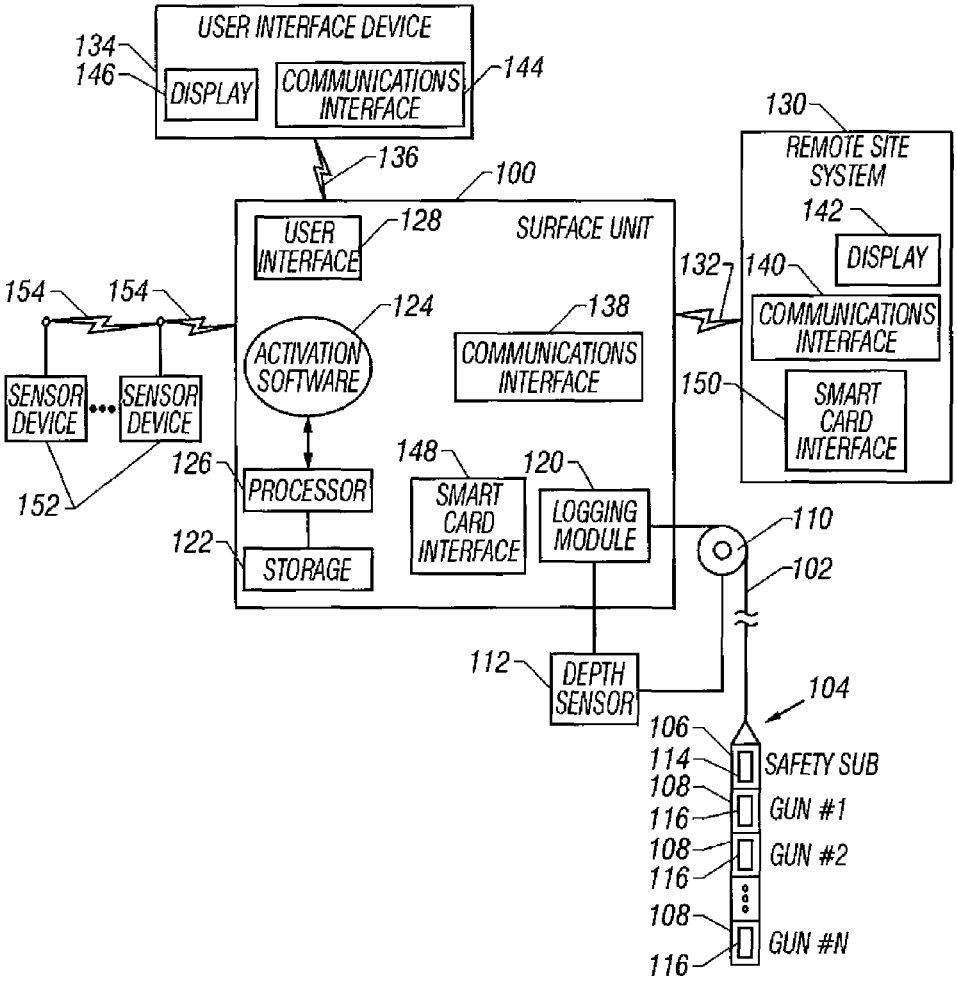
FIG. 1 is block diagram of an example arrangement of control systems, sensors, and a downhole well tool.

Referring to FIG. 1, a system according to one embodiment includes a surface unit 100 that is coupled by cable 102 (e.g., a wireline) to a tool 104. In the example shown in FIG. 1, the tool 104 is a tool for use in a well. For example, the tool 104 can include a perforating tool or other tool containing explosive devices, such as pipe cutters and the like. In other embodiments, other types of tools can be used for performing other types of operations in a well. For example, such other types of tools include tools for setting packers, opening or closing valves, logging, taking measurements, core sampling, and so forth. In the embodiments described below, safety issues associated with well tools containing explosive devices are discussed. However, similar methods and apparatus can be applied to tools having explosive devices in other applications, e.g., mining, seismic acquisition, surface demolition, armaments, and so forth.

The tool 104 includes a safety sub 106 and a plurality of guns 108. In one embodiment, the safety sub 106 differs from the gun 108 in that the safety sub 106 does not include explosive devices that are present in the guns 108. The safety sub 106 serves one of several purposes, including providing a quick connection of the tool 104 to the cable 102. Additionally, the safety sub 106 allows electronic arming of the perforating tool 104 downhole instead of at the surface.

Because the safety sub 106 does not include explosive devices, it provides electrical isolation between the cable 102 and the guns 108 so that electrical activation of the guns 108 is disabled until the safety sub 106 has been activated to close an electrical connection.

In the example of FIG. 1, the cable 102 is run through a winch assembly 110, which is coupled to a depth sensor 112. The depth sensor 112 monitors the rotation of the winch assembly 110 to determine the depth of the perforating tool 104. The data relating to the depth of the tool 104 is communicated to the surface unit 100.

In some systems, an internal (hardware or software) drive system can be used to simulate that the tool 104 has descended to a certain depth in the wellbore, even though the tool 104 is still at the earth surface. The depth sensor 112 can be used by the surface unit to verify that the tool 104 has indeed been lowered into the wellbore to a target depth. As a safety precaution, the ability to use the output of the internal hardware or drive system to enable activation of the tool 104 is prohibited.

The perforating tool 104 also includes a number of sensors, such as sensors 114 in the safety sub and sensors 116 in the guns 108. Although FIG. 1 shows each gun 108 as containing sensors 116, less than all of the guns can be selected to include sensors in other embodiments.

Data from the sensors 114 and 116 are communicated over the cable 102 to a logging module 120 in the surface unit 100. The logging module 120 is capable of performing bi-directional communications with the sensors 114 and 116 over the cable 102. For example, the logging module 120 is able to issue commands to the sensors 114 and 116 to take measurements, and the logging module 120 is then able to receive measurement data from the sensors 114 and 116. Data collected by the logging module 120 is stored in a storage 122 in the surface unit 100. Examples of the storage 122 include magnetic media (e.g., a hard disk drive), optical media (e.g., a compact disk or digital versatile disk), semiconductor memories, and so forth. The surface unit 100 also includes activation software 124 that is executable on a processor 126. The activation software 124 is responsible for managing the activation of the perforating tool 104 in response to user commands. The user commands can be issued from a number of sources, such as directly through a user interface 128 at the surface unit 100, from a remote site system 130 over a communications link 132, or from a portable user interface device 134 over a communications link 136.

In one embodiment, the communications links 132 and 136 include wireless links, in the form of radio frequency (RF) links, infrared (IR) links, and the like. Alternatively, the communications links 132 and 136 are wired links. The surface unit 100 includes a communications interface 138 for communicating with the user interface device 134 and the remote site system 130 over the respective links. The remote site system 130 also includes a communications interface 140 for communicating over the communications link 132 to the surface unit 100. Also, the remote site system 130 includes a display 142 for presenting information (e.g., status information, logging information, etc.) associated with the surface unit 100.

The user interface device 134 also includes a communications interface 144 for communicating over the communications link 136 with the surface unit 100. Additionally, the user interface device 134 includes a display 146 to enable the user to view information associated with the surface unit 100. An example of the user interface device 134 is a personal digital assistant (PDA), such as a PALM® device, a WINDOWS® CE device, or other like device. Alternatively, the user interface device 134 includes a laptop or notebook computer.

In accordance with an embodiment, a security feature of the surface unit 100 is a smart card interface 148 for interacting with a smart card of a user. The smart card interface 148 is capable of reading identification information of the user (e.g., a digital signature, a user code, an employee number, and so forth). The activation software 124 uses this identification information to determine if the user is authorized to access the surface unit 100 and to perform activation of the perforating tool 104. The identification information is part of the "authorization code" provided by a user to gain access to the surface unit 100.

A smart card is basically a card with an embedded processor and storage, with the storage containing various types of information associated with a user. Such information includes a digital signature, a user profile, and so forth.

In an alternative embodiment, instead of a smart card interface 148, the surface unit 100 can include another type of security feature, such as providing a prompt in which a user has to enter his or her user name and password. In yet another embodiment, the security mechanism of the surface unit 100 includes a biometric device to scan a biometric feature (e.g., fingerprint) of the user. The user interface device 134 can similarly include a smart card reader or biometric input device.

Alternatively, the user enters information and commands using either the user interface device 134 or the remote site system 130. The user interface device 134 may itself store an authorization code, such as in the form of a user code, digital signature, and the like, that is communicated to the surface unit 100 with any commands issued by the user interface device 134. Only authorized user interface devices 134 are able to issue commands that are acted on by the surface unit 100. Although not shown, the user interface device 134 can optionally include a smart card interface to interact with the smart card of the user.

In the example shown, the remote site system 130 also includes a smart card interface 150. Thus, before a user is able to issue commands from the remote site system 130 to the surface unit 100 to perform various actions, the user must be in possession of a smart card that enables access to the various features provided by the surface unit 100.

In this way, the surface unit 100 cannot be accessed by unauthorized users. Therefore, safety problems associated with the unauthorized use of the perforating tool 104 is avoided.

Another safety feature offered by the perforating tool 104 is that each of the guns 108 is associated with a unique code or identifier. This code or identifier must be issued by the surface unit 100 with an activate command for the gun 108 to be activated. If the code or identifier is not provided, then the gun 108 cannot be fired. Thus, if the perforating tool 104 is stolen or is lost, unauthorized users will not be able to activate the guns 108 since they do not know what the codes or identifiers are. The safety sub 106 is also associated with a unique code or identifier that must be received by the safety sub 106 for the safety sub 106 to be activated to electrically arm the perforating tool 104.

Another feature allowed by using unique codes or identifiers for the guns 108 is that the guns can be traced (to enable the tracking of lost or misplaced guns). Also, the unique codes or identifiers enable inventory control, allowing a well operator to know the equipment available for well operations.

Yet another safety feature associated with the guns 108 according to one embodiment is that they use exploding foil initiators (EFIs), which are safe in an environment in which wireless signals, such as RF signals, are present. As a result, this feature of the guns 108 enables the use of RF communications between the surface unit 100 and the remote site system 130 and with the user interface device 134. However, in other embodiments, conventional detonators can be used in the perforating tool 104, with precautions taken to avoid use of RF signals. The EFI detonator is one example of an electro-explosive device (EED) detonator, with other examples including an exploding bridge wire (EBW) detonator, semiconductor bridge detonator, hot-wire detonator, and so forth.

Another feature offered by the surface unit 100 according to some embodiments is the ability to perform "interactive" activation of the perforating tool 104. The "interactive" activation feature refers to the ability to communicate with the sensors 114 and/or 116 in the perforating tool 104 before, during, and after activation of the perforating tool 104. For example, the sensors 114 and/or 116 are able to take pressure measurements (to determine if an under balance or over balance condition exists prior to perforating), take temperature measurements (to verify explosive temperature ratings are not exceeded), and take fluid density measurements (to differentiate between liquid and gas in the wellbore). Also, the surface unit 100 is able to interact with the depth sensor 112 to determine the depth of the perforating tool 104. This is to ensure that the perforating tool 104 is not activated prior to it being at a safe depth in the wellbore. As an added safety precaution, a user will be prevented from artificially setting the depth of the perforating tool below a predetermined depth for test purposes. In some systems, such a depth can be set by software or hardware to simulate the tool being in the wellbore. However, due to safety concerns, artificially setting the depth to a value where a gun is allowed to be activated is prohibited.

The sensors 114 and/or 116 may also include voltage meters to measure the voltage of the cable 102 at the upper head of the perforating tool 104, the voltages at the detonating devices in the respective guns 108, the amount of current present in the cable 102, the impedance of the cable 102 and other electrical characteristics. The sensors may also include accelerometers for detecting tool movement as well as shot indication. Shot indication can be determined from waveforms provided by accelerometers over the cable 102 to the surface unit 100. Alternatively, the waveform of the discharge voltage on the cable 102 can be monitored to determine if a shot has occurred.

The sensors 114 and/or 116 may also include moisture detectors to detect if excessive moisture exists in each of the guns 108. Excessive moisture can indicate that the gun may be flooded and thus may not fire properly or at all.

The sensors may also include a position or orientation sensor to detect the position or orientation of a gun in well, to provide an indication of well deviation, and to detect correct positioning (e.g., low side of casing) before firing the gun. Also, the sensors may include a strain-gauge bridge sensor to detect external strain on the perforating tool 104 that may be due to pulling or other type of strain on the housing or cable head of a gun that is stuck in the well. Other types of sensors include acoustic sensors (e.g., a microphone), and other types of pressure gauges.

Other types of example sensors include equipment sensors (e.g., vibration sensors), sand detection sensors, water detection sensors, scale detectors, viscosity sensors, density sensors, bubble point sensors, composition sensors, infrared sensors, gamma ray detectors, $H_2S$ detectors, $CO_2$ detectors, casing collar locators, and so forth.

One of the aspects of the sensors 116 is that they are destroyed with firing of the guns 108. However, the sensors 114 in the safety sub 106 may be able to survive detonation of the guns 108. Thus, these sensors 114 can be used to monitor well conditions (e.g., measure pressure, temperature, and so forth) before, during, and after a perforating operation.

In addition to the sensors that are present in the perforating tool 104, other sensors 152 can also be located at the earth surface. The sensors 152 are able to detect shock or vibrations created in the earth due to activation of the perforating tool 104. For example, the sensors 152 may include geophones. The sensors 152 are coupled by a communications link 154, which may be a wireless link or a wired link, to the surface unit 100. Data from the sensors 152 to the surface unit 100 provide an indication of whether the perforating tool 104 has been activated.

Figure 2:
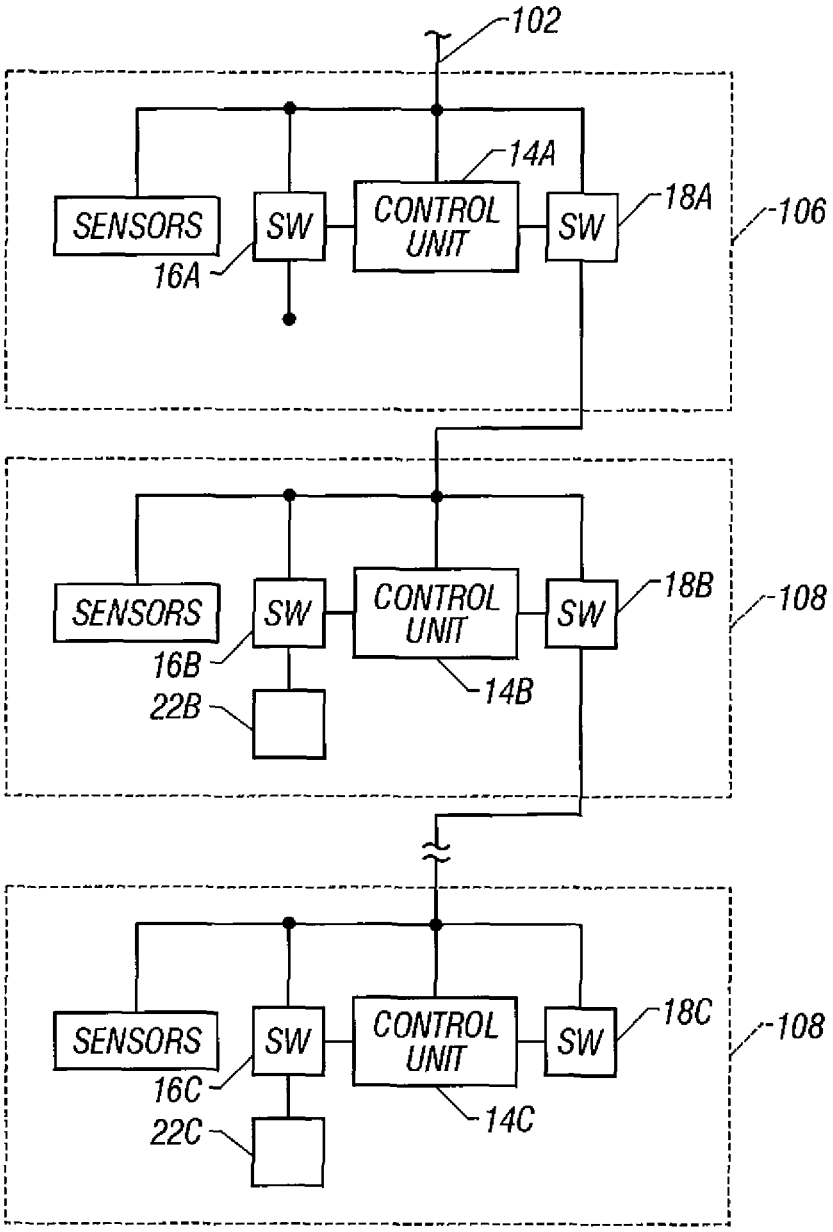
FIG. 2 is a block diagram of a perforating tool, according to one embodiment, that can be used in the system of FIG. 1.

The safety sub 106 and guns 108 of the perforating tool 104 are shown in greater detail in FIG. 2. In the example shown in FIG. 2, the safety sub 106 includes a control unit 14A, and the guns 108 include control units 14B, 14C. Although only two guns 108 are shown in the example FIG. 2, other embodiments may include additional guns 108. Each control unit 14 is coupled to switches 16 and 18 (illustrated at 16A-16C and 18A-18C). The switches 18A-18C are cable switches that are controllable by the control units 14A-14C, respectively, between on and off positions to enable or disable current flow through portions of the cable 102. When the switch 18 is off, then the portion of the cable 102 below the switch 18 is isolated from the portion of the cable 102 above the switch 18. The switches 16A-16C are detonating switches.

In the safety sub 106, the detonating switch 16A is not connected to a detonating device. However, in the guns 108, the detonating switches 16B, 16C are connected to detonating devices 22B, 22C, respectively. If activated to an on position, a detonating switch 16 allows electrical current to flow to a coupled detonating device 22 to activate the detonating device. The detonating device 22B, 22C includes an EFI detonator or other detonators. The detonating devices 22B, 22C are ballistically coupled to explosives, such as shaped charges or other explosives, to perform perforating.

As noted above, the safety sub 106 provides a convenient mechanism for connecting the perforating tool 104 to the cable 102. This is because the safety sub 106 does not include a detonating device 22 or any other explosive, and thus does not pose a safety hazard. The switch 18A of the safety sub 106 is initially in the open position, so that all guns of the perforating tool 104 are electrically isolated from the cable 102 by the safety sub 106. Because of this feature, electrically arming of the perforating tool 104 does not occur until the perforating tool 104 is positioned downhole and the switch 18A is closed.

Another feature allowed by the safety sub 106 is that the guns 108 can be pre-armed (by connecting each detonating device 22 in the gun 108) during transport or other handling of the perforating tool 104. Thus, even though the perforating tool 104 is transported ballistically armed, the open switch 18A of the safety sub 106 electrically isolates the guns 108 from any activation signal during transport or other handling.

Figure 3A:
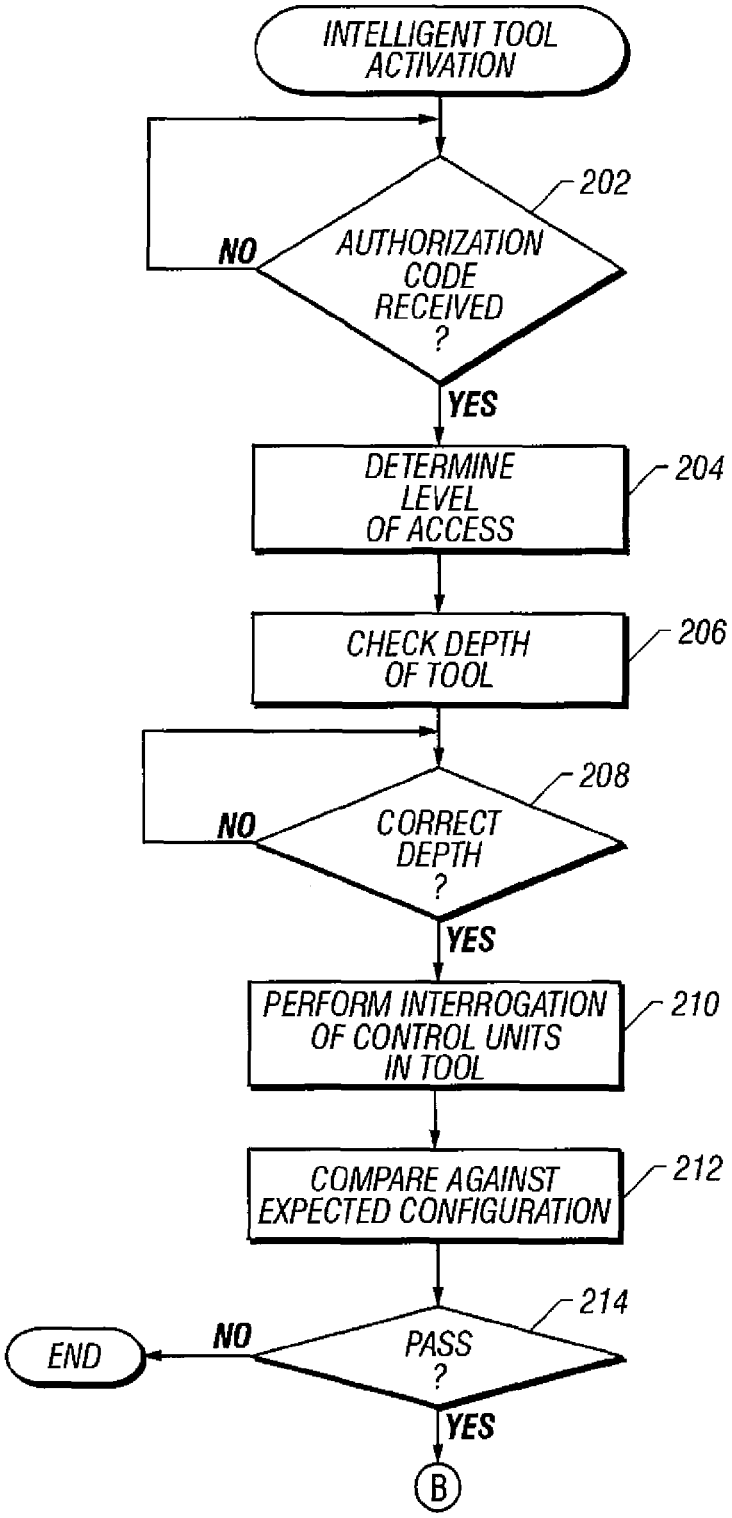
FIGS. 3A-3B are a flow diagram of a process performed by a surface unit in accordance with an embodiment.
Figure 3B:
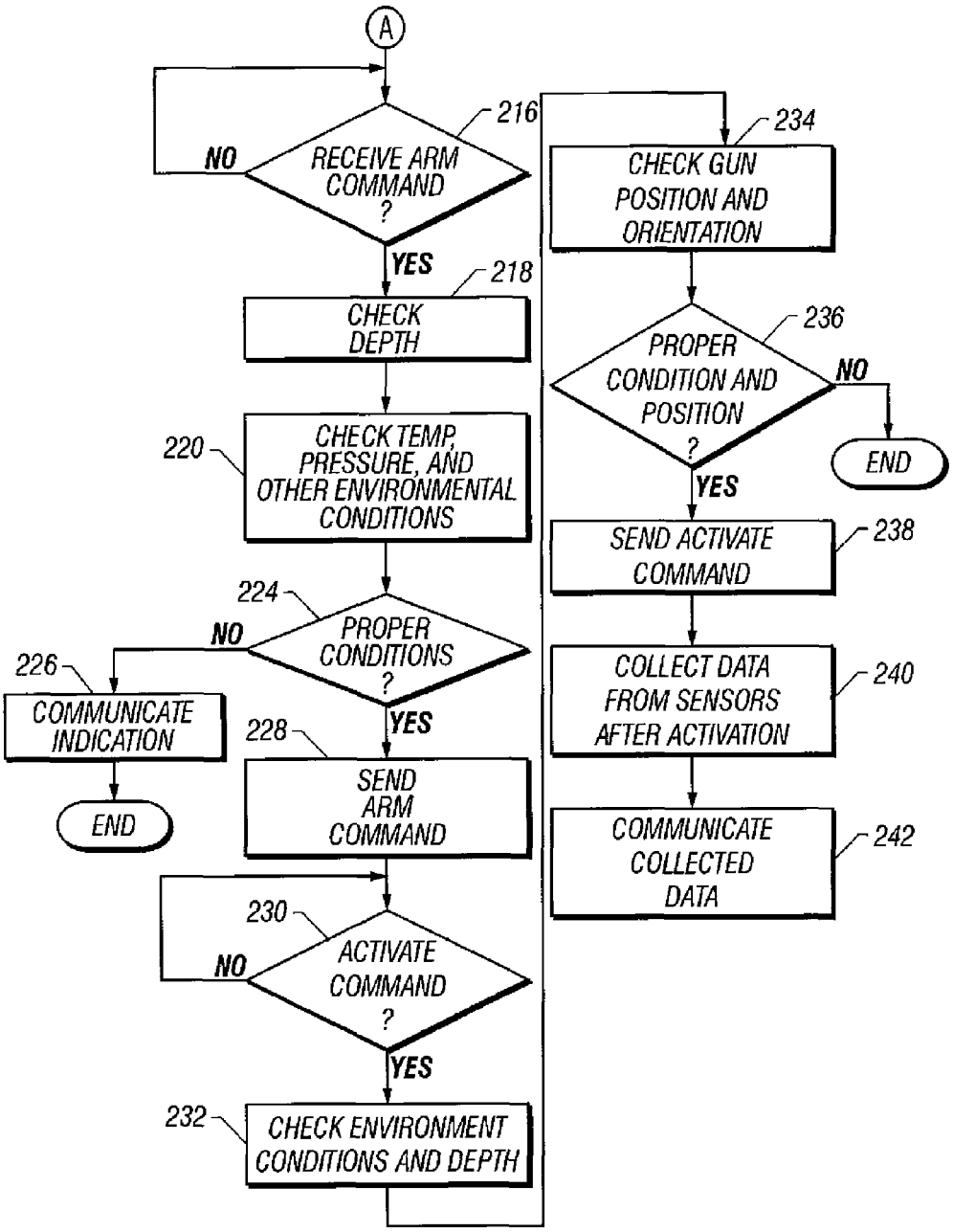

FIGS. 3A-3B are a flow diagram of a tool activation process, which is performed by the activation software 124 according to one embodiment. Before access is provided for activating the perforating tool 104, the activation software 124 checks (at 202) if an authorization code has been received. The authorization code includes a digital signature, a user code, a user name and password, or some other code. The authorization code can be stored on a smart card and communicated to the surface unit 100 through the smart card interface 148. Alternatively, the authorization code can be manually entered by the user through a user interface.

If an authorization code has been received and verified, the activation software 124 determines (at 204) the level of access provided to the user. Users are assigned a hierarchy of usage levels, with some users provided with a higher level of access while others are provided with a lower level of access. For example, a user with a higher level of access is authorized to activate the perforating tool to fire guns. A user with a lower access level may be able only to send inquiries to the perforating tool to determine the configuration of the perforating tool, and possibly, to perform a test of the perforating tool (without activating the detonating devices 22 in the perforating tool 104).

The activation software 24 also checks (at 206) for a depth of the perforating tool 104 in the well. Activation of the perforating tool 104 is prohibited unless the perforating tool 104 is at the correct depth. While the perforating tool 104 is not at a correct depth, as determined (at 208), further actions are prevented. However, once the perforating tool 104 is at the correct depth, the activation software 124 performs (at 210) various interrogations of control units 14 in the perforating tool 100. Interrogations may include determining the positions of switches 16 and 18 in the perforating tool 104, the status of the control unit 14, the configuration and arrangement of the perforating tool 104 (e.g., number of guns, expected identifications or codes of each control unit, etc.), and so forth.

Once the status information has been received from the perforating tool 104, the activation software 124 compares (at 212) the information against an expected configuration of the perforating tool 104. Based on the interrogations and the comparison performed at 210 and 212, the activation software 124 determines (at 214) if the perforating tool 104 is functioning properly or is in the proper configuration. If not, then the activation process ends with the tool 104 remaining deactivated. However, if the tool is determined to be functioning properly and in the expected configuration, the activation software 124 waits (at 216) for receipt of an arm command from the user. The arm command can be provided by the user through the user interface 128 of the surface unit 100, through the user interface device 134, or through the remote site system 130.

Upon receipt of the arm command, the activation software 124 checks (at 218) the depth of the perforating tool 104 again. This is to ensure that the perforating tool 104 has not been raised from its initial depth.

Next, the activation software 124 checks (at 220) for various downhole environment conditions, including pressure, temperature, the presence of gas or liquid, the deviation of the wellbore, and so forth.

If the proper condition is not present, as determined at 224, the activation software 124 communicates (at 226) an indication to the user, such as through the user interface 128 of the surface unit 100, the display 146 of the user interface device 134, or the display 142 of the remote site system 130. Arming is prohibited.

However, if the condition of the well and the position of the perforating tool 104 is proper, the activation software 124 issues an arm command (at 228) to the perforating tool 100. The arm command is received by the safety sub 106, which closes the cable switch 18A in response to the arm command. Optionally, the cable switches 18B, 18C can also be actuated closed at this time.

The activation software 124 waits (at 230) for receipt of an activate command from the user. Upon receipt of the activate command, the activation software 124 re-checks (at 232) the environment conditions and the depth of the penetrating tool. The activation software 124 also checks (at 234) the gun position and orientation. It may be desirable to shoot the gun at a predetermined angle with respect to the vertical. Also, the shaped charges of the perforating tool 104 may be oriented to shoot in a particular direction, so the orientation has to be verified.

If the environment condition and gun position is proper, as determined at 236, the activation software 124 sends (at 238) the activate command to the perforating tool 104. The activate command may be encrypted by the activation software 124 for communication over the cable 102. The control units 14 in the perforating tool 104 are able to decrypt the encrypted activate command. In one embodiment, the activate command is provided with the proper identifier code of each control unit 14. Each control unit 14 checks this code to ensure that the proper code has been issued before activating the appropriate switches 16 and 18 to fire the guns 108 in the perforating tool 104.

In one sequence, the guns 108 of the perforating tool 104 are fired sequentially by a series of activate commands. In another sequence, the activate command is provided simultaneously to all guns 108, with each gun 108 preprogrammed with a delay that specifies the delay time period between the receipt of the activate command and the firing of the gun 108. The delays in plural guns 108 may be different.

During and after activation of the perforating tool 104, measurement data is collected (at 240) from the various sensors 114, 116, and 152. The collected measurement data is then communicated (at 242) to the user.

Figure 4:
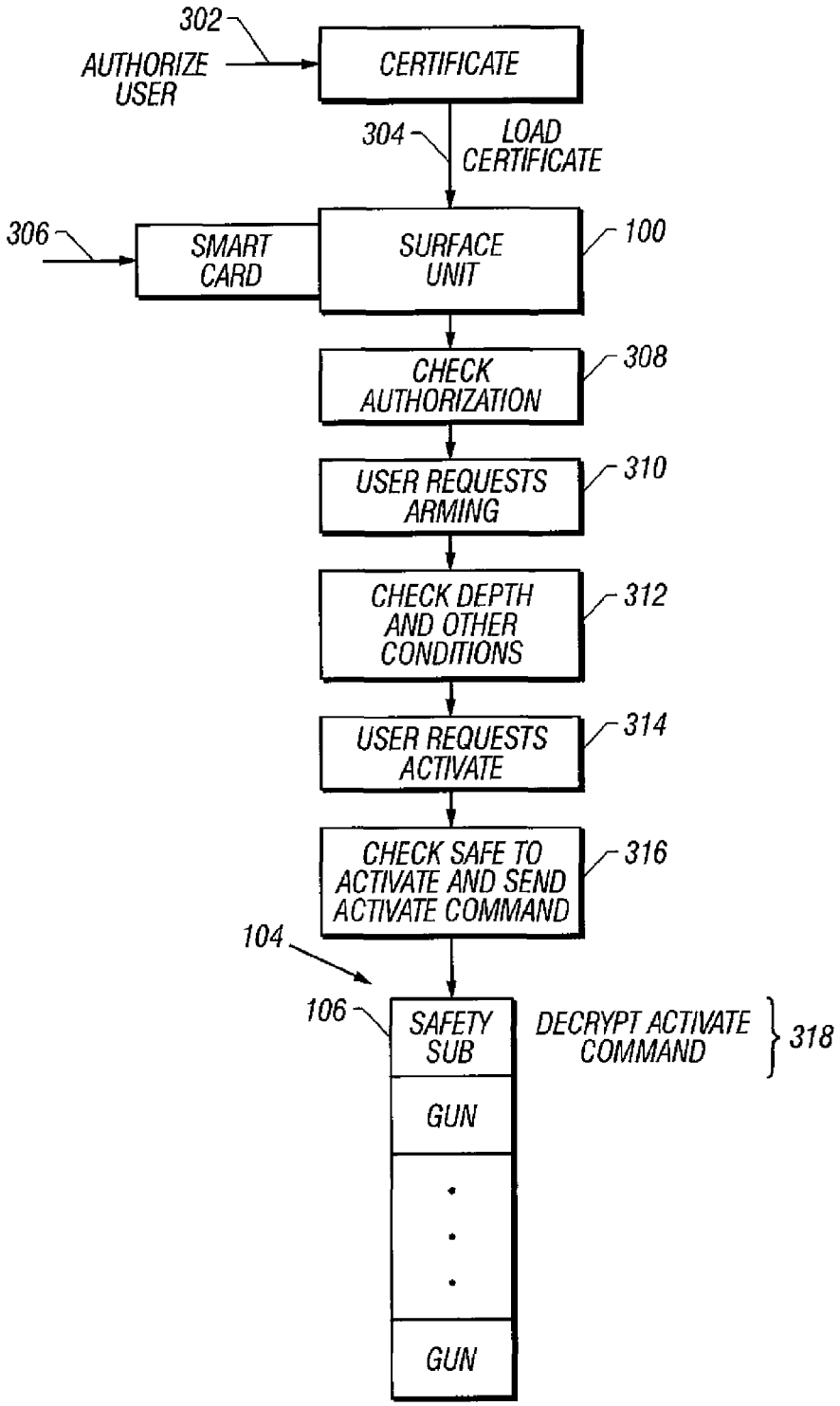
FIGS. 4 and 5 illustrate processes for secure and interactive activation of a perforating tool.

FIG. 4 illustrates a flow diagram of a process of performing secure activation of an explosive tool, such as the perforating tool 104, according to one embodiment. A central management site (not shown) provides (at 302) a profile of a user that includes his or her associated identifier, authorization code, personal identification number (PIN) code, digital signature, and access level. This profile is loaded as a certificate (at 304) into the surface unit 100, where it is stored in the storage 122. During use, a user inserts (at 306) his or her smart card into the smart card interface 148 of the surface unit 100. The surface unit 100 may prompt for a PIN code through the user interface 128, which is then entered by the user. The surface unit 100 checks (at 308) to ensure that a user is authorized to use a system based on the stored certificate and notifies the user of access grant.

Next, the user requests (at 310) arming of the perforating tool 104, which is received by the surface unit 100. In response, as discussed above, the surface unit 100 checks (at 312) the depth of the perforating tool 104 and the data from other sensors from the perforating tool 104 to determine if the perforating tool 104 is safe to arm.

The user then issues a fire command (at 314), which is received by the surface unit 100. The surface unit 100 then checks (at 316) that the perforating tool 104 is safe to activate, and if so, sends an encrypted activate command to the perforating tool 104.

The control unit 14A in the safety sub 106 stores a private key at manufacture. This private key is used by the control unit 14A in the safety sub 106 to decrypt the activate command (at 318). The decrypted activate command is then forwarded to the guns 108 to fire the guns.

Figure 5:
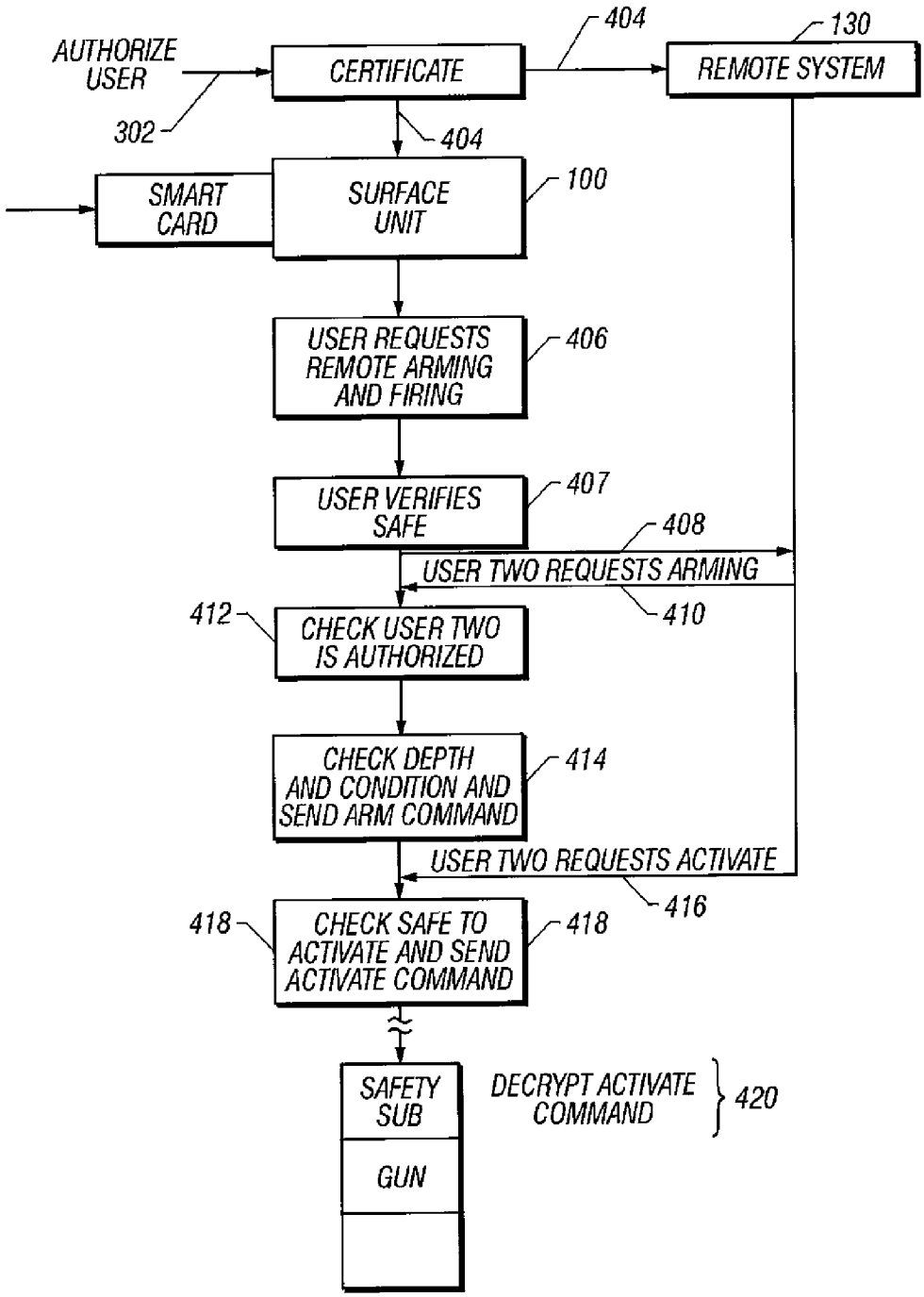

FIG. 5 illustrates a flow diagram of a process of remotely activating the perforating tool 104. In the context of FIG. 1, the remote activation is performed by a user at the remote site system 130. In the example of FIG. 5, two users are involved in remotely activating the perforating tool 104, with user 1 at the well site and user 2 at the remote site system 130. As before, a central management system authorizes user names and their associated information and access levels (at 302) and communicates certificates containing the profiles (at 404) to the surface unit 100 and to the remote site system 130 for storage.

At the surface unit 100, user 1 inserts (at 406) his or her smart card into the surface unit 100, along with the user's PIN code, to request remote arming and activation of the perforating tool 104. This indication is communicated (at 408) from the surface unit 100 to the remote site system 130 over the communications link 132. User 1 also verifies (at 407) that all is safe and ready to fire at the surface unit 100.

User 2 inserts his or her smart card into the smart card interface 150 of the remote site system 130 to gain access to the remote site system 130. Once authorized, user 2 requests (at 410) arming of the perforating tool 104. The surface unit 100 checks (at 412) that user 2 is authorized by accessing the certificate stored in the surface unit 100. This check can alternatively be performed by the remote site system 130.

The surface unit 100 then checks (at 414) the depth of the perforating tool 104 along with data from other sensors of the perforating tool 104 to ensure that the perforating tool 104 is safe to arm. Once the verification has been performed and communicated back to the remote site system 130, user 2 issues an activate command (at 416) at the remote site system 130. The surface unit 100 checks (at 418) to ensure that the perforating tool 104 is safe to activate, and then sends an encrypted activate command. The encrypted activate command is received by the safety sub 106, with the encrypted activate command decrypted (at 420) by the control unit 14A in the safety sub 106.

Figure 6:
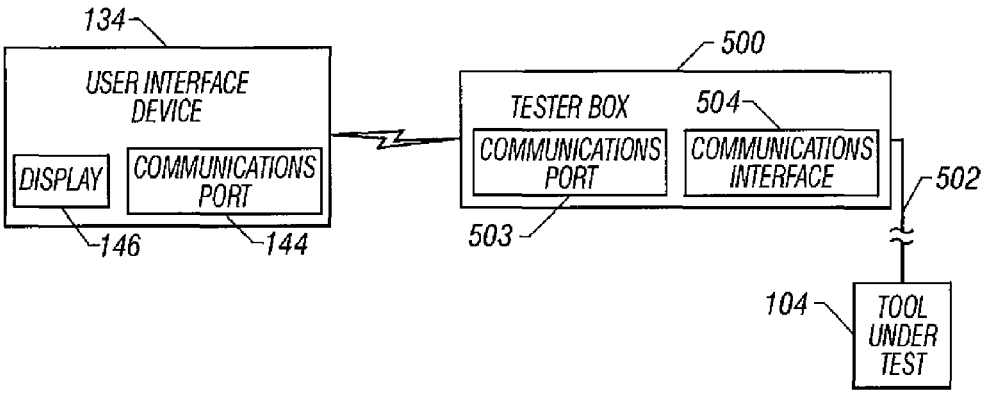
FIG. 6 is a block diagram of an example test arrangement including a tester box coupled to a tool under test, and a user interface device to control the tester box.

According to some embodiments of the invention, another feature is the ability to test the perforating tool 104 to ensure the perforating tool 104 is functioning properly. The test can be performed at the well site or at an assembly shop that is remote from the well site. To do so, as shown in FIG. 6, a tester box 500 is coupled to the perforating tool 104 over a communications link 502 through a communications interface 504. If the test is performed at the well site, the tester box 500 can be implemented in the surface unit 100. At the assembly shop or at some other location, the tester box 500 is a stand-alone unit. The tester box 500 includes a communications port 503 that is capable of performing wireless communications with communications port 144 in the user interface device 134. The communications can be in the form of IR communications, RF communications, or other forms of wireless communications. The communications between the user interface device 134 and the tester box 500 can also be over a wired link.

In one embodiment, various graphical user interface (GUI) elements (e.g., windows, screens, icons, menus, etc.) are provided in the display 146 of the user interface device 134. The GUI elements include control elements such as menu items or icons that are selectable by a user to perform various acts. The GUI elements also include display boxes or fields in which information pertaining to the perforating tool 104 is displayed to the user.

In response to user selection of various GUI elements, the user interface device 134 sends commands to the tester box 500 to cause a certain task to be performed by control logic in the tester box 500. Among the actions taken by the tester box 500 is the transmission of signals over the cable 502 to test the components of the perforating tool 104. Feedback regarding the test is communicated back to the tester box 500, which in turn communicates data over the wireless medium to the user interface device 134, where the information is presented in the display 146. As an added safety feature, the tester box 500 can also include a smart card reader or biometric input device to verify user authorization.

A more detailed description of the tester box 500 and components in the perforating tool 104 to enable this testing feature is discussed in greater detail in U.S. Ser. No. 09/997,021, entitled "Communicating with a Tool," filed Nov. 28, 2001, now U.S. Pat. No. 6,938,689, which is hereby incorporated by reference.

The various systems and devices discussed herein each includes various software routines or modules. Such software routines or modules are executable on corresponding control units or processors. Each control unit or processor includes a microprocessor, a microcontroller, a processor card (including one or more microprocessors or microcontrollers), or other control or computing devices. As used here, a "controller" refers to a hardware component, software component, or a combination of the two. Although used in the singular sense, a "controller" can also refer to plural hardware components, plural software components, or a combination thereof.

The storage devices referred to in this discussion include one or more machine-readable storage media for storing data and instructions. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs). Instructions that make up the various software routines or modules in the various devices or systems are stored in respective storage devices. The instructions when executed by a respective control unit or processor cause the corresponding node or system to perform programmed acts.

The instructions of the software routines or modules are loaded or transported to each device or system in one of many different ways. For example, code segments including instructions stored on floppy disks, CD or DVD media, a hard disk, or transported through a network interface card, modem, or other interface device are loaded into the device or system and executed as corresponding software routines or modules. In the loading or transport process, data signals that are embodied in carrier waves (transmitted over telephone lines, network lines, wireless links, cables, and the like) communicate the code segments, including instructions, to the device or system. Such carrier waves are in the form of electrical, optical, acoustical, electromagnetic, or other types of signals.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system for activating a well tool, wherein the well tool comprises a perforating gun, comprising:

a controller having an interface to communicate with the well tool, the controller further having a security input unit configured to receive an authorization code, the controller configured to verify the authorization code; and the interface configured to receive data pertaining to the well tool and an environment of the well tool, the data comprising pressure and temperature components, the controller configured to, in response to a user request to activate the well tool:

verify the authorization code, wherein the verification comprises a verification of an access level of having authority to activate the well tool;

determine if data pertaining to the environment of the well tool indicates it is safe to activate the well tool; and send a command including a unique code from an earth surface location to a downhole location to selectively activate and fire the well tool in response to the received data pertaining to the environment of the well tool indicating that it is safe to activate the well tool; or selectively disable activation of the well tool in response to the received data indicating that it is not safe to activate the well tool.

2. The system of claim 1, further comprising a communications interface configured to wirelessly communicate with a remote site.

3. The system of claim 2, wherein the communications interface is configured to communicate with the remote site using radio frequency signaling.

4. The system of claim 1, wherein the data pertaining to the environment comprises a depth of the well tool at the downhole location.

5. The system of claim 1, wherein the command is an encrypted command that is decryptable by the well tool.

6. The system of claim 1, wherein the authorization code includes information from a smart card and a personal identification code from a user.

7. The system of claim 1 further comprising the controller configured to verify the user to a lower access level, wherein the controller allows the user with the lower access level to perform at least one of:

determine the configuration of the well tool; and perform a test of the well tool without activating the tool.

8. A system for activating a well tool, wherein the well tool comprises a perforating gun, comprising:

a controller having an interface to communicate with the well tool, the controller further having a security input unit configured to receive an authorization code, the controller configured to verify the authorization code to an access level; and the interface configured to receive data pertaining to an environment of the well tool, wherein the data comprises an indication of the presence or absence of liquid or gas, wherein the security input unit comprises a smart card reader configured to receive the authorization code stored on a smart card, and wherein the controller is configured to further:

enable activation and firing of the well tool in response to verifying the authorization code received by the smart card reader is to an activation access level and determining that the received data satisfies one or more predetermined criteria indicating that it is safe to activate the well tool, wherein the activation is enabled by a unique code issued by the controller; and disable activation of the well tool in response to the received data not satisfying the one or more predetermined criteria.

9. The system of claim 8, wherein the security input unit is further configured to receive a password from a user.

10. The system of claim 8, wherein the controller is configured to send an encrypted command that is decryptable by the well tool.

11. The system of claim 8, wherein the controller is configured to enable at least one of:

data collection from the well tool or well tool environment; and testing of the well tool, in response to verifying the authorization code received by the smart card reader is to an access level lower than the activation access level.

* * * * *